United States Patent [19]

Kanno et al.

[11] Patent Number: 4,707,109

[45] Date of Patent: Nov. 17, 1987

[54] ELECTROPHOTOGRAPHIC APPARATUS CAPABLE OF EDITING A COPY PICTURE IMAGE

[75] Inventors: Masashi Kanno, Katano; Katsufumi Komori, Hirakata; Masaichirou Tatekawa, Sakai; Kiyohito Miwa, Osaka; Iwane Takaoka, Utsunomiya, all of Japan

[73] Assignee: Matsushita Electric Industrial Co., Ltd., Osaka, Japan

[21] Appl. No.: 752,951

[22] Filed: Jul. 8, 1985

[30] Foreign Application Priority Data

Jul. 6, 1984 [JP] Japan ..... 59-140862
Jul. 6, 1984 [JP] Japan ..... 59-140870
Jul. 9, 1984 [JP] Japan ..... 59-141914

[51] Int. Cl.[4] ..... G03G 15/00

[52] U.S. Cl. ..... 355/7; 355/3 R; 355/14 R; 340/707; 340/708

[58] Field of Search ..... 355/7, 3 R, 14 R, 8, 355/1, 14 E; 340/707, 708

[56] References Cited

U.S. PATENT DOCUMENTS

| | | | |
|---|---|---|---|
| 4,190,347 | 2/1980 | Siegmund | 355/1 |
| 4,215,929 | 8/1980 | Sato et al. | 355/7 |
| 4,322,157 | 3/1982 | Miura et al. | 355/7 X |
| 4,340,295 | 7/1982 | Nakamura | 355/7 X |
| 4,352,550 | 10/1982 | Uchida | 355/1 X |
| 4,371,898 | 2/1983 | Nakamura | 355/7 X |
| 4,402,599 | 9/1983 | Seto | 355/1 X |
| 4,436,409 | 3/1984 | Queener | 355/7 X |
| 4,451,895 | 5/1984 | Sliwkowski | 340/708 X |
| 4,475,239 | 10/1984 | Van Raamsdonk | 340/707 X |
| 4,555,699 | 11/1985 | Citron et al. | 340/707 |
| 4,582,417 | 4/1986 | Yagasaki et al. | 355/7 |

FOREIGN PATENT DOCUMENTS

| | | | |
|---|---|---|---|
| 59-93440 | 5/1984 | Japan . | |
| 59-87470(A) | 5/1984 | Japan | 355/1 |
| 59-88754(A) | 5/1984 | Japan | 355/14 E |
| 59-88757(A) | 5/1984 | Japan | 355/14 E |

OTHER PUBLICATIONS

Poe, "The Long and Short of Copiers", *High Technology*, pp. 57 & 58, May, 1986.

*Primary Examiner*—A. C. Prescott
*Attorney, Agent, or Firm*—Wenderoth, Lind & Ponack

[57] ABSTRACT

An electrophotographic apparatus capable of editing a copy picture image includes a document table for mounting a document thereon and a document irradiator for irradiating a surface of the document, and an optical system for focusing the reflected image from the surface of the document onto a photosensitive body so as to produce a latent image thereon. A photosensitive body irradiator is further provided for directly and selectively irradiating at least a part of the photosensitive body to erase a part of the latent image on the irradiated part of the photosensitive body. The resultant latent image is then developed in the usual fashion to form a visible image on a plain sheet. A position and function selector is provided separately from the document table and includes a tablet for first mounting the document thereon prior to the document being mounted on the document table and further includes a pen arranged such that a position on the tablet is detected by an access of the pen. The tablet is divided into a position selecting area and a function selecting area. Lastly, a controller is provided for controlling the document irradiator and the photosensitive body irradiator in accordance with signals from the position and function.

11 Claims, 12 Drawing Figures

ELECTROPHOTOGRAPHIC APPARATUS CAPABLE OF EDITING A COPY PICTURE IMAGE

BACKGROUND OF THE INVENTION

1. Field of the Invention

The present invention generally relates to an electrophotographic apparatus using the so-called Carlson process in which an image on a document surface is copied onto an ordinary paper, and more particularly to an electrophotographic apparatus in which a position on a document surface is selected and the intensity of exposure to a photosensitive body is controlled in accordance with the selected position on the document surface so that it is possible to perform various processes with respect to a copy picture image according to the selected position.

2. Description of the Prior Art

FIG. 1 shows a main part schematic arrangement of an example of a conventional electrophotographic apparatus using the Carlson process. In FIG. 1, in copying, a photosensitive body 1 is rotated in the direction of the arrow 2. First, charges are uniformly applied to the surface of the photosensitive body 1 by corona charging from a charger 3. A document surface 5 of a document 4 is irradiated by a fluorescent lamp 6 functioning as a document irradiation means and a reflection image of the document surface 5 is focused onto the photosensitive body 1 through a focusing optical system 7 such as an optical fiber arrangement functioning as a lens, so that the document surface image is exposed successively from the right end to the left end of the document surface 5 onto the photosensitive body 1 in synchronism with the rotation of the photosensitive body 1 so as to thereby to form thereon an electrostatic latent image. A developer 8 allows toners to be adhered to the photosensitive body 1 in accordance with distribution of charges caused by the electrostatic latent image, so as to thereby to form a visible image on the photosensitive body 1. The visible image is transferred by a transfer charger 9 onto a copy sheet 10 moved in the direction of the arrow 11 in synchronism with the rotation of the photosensitive body 1 in the direction of the arrow 2 so as to form a copy picture image on the sheet 10. Here, it is known that one of primary factors which determine the density of the copy picture image is the quantity of residual charges of the electrostatic latent image and the quantity of residual charges is determined in accordance with the intensity of exposure to the photosensitive body 1.

Recently, in obtaining a copy picture image, there are such requirements that the density of the picture image would be adjusted and various processes would be performed with respect to the picture image, such that, for example, a specified portion of the picture image is erased or alternatively only the specified portion is caused to remain.

In the conventional electrophotographic apparatus, however, an exposure light source to the photosensitive body 1 is only a single fluoroscent lamp 6, and moreover light from the fluorescent lamp 6 is reflected from the document surface 5 to irradiate the photosensitive body 1, there being provided no irradiation means for directly irradiating the photosensitive body 1. Accordingly, the intensity of exposure to the photosensitive body 1 can be decreased, but, on the contrary, it is not practical to increase the intensity of exposure because the quantity of light emission of the fluorescent lamp 6 must be greatly increased. As a matter of course, if it is intended that a specified portion of the document picture image is to be erased, it is difficult to adjust the intensity of exposure for every sectioned region in accordance with a selected position. In other words, it has been difficult to perform copy picture image control.

An example of the conventional electrophotographic apparatus which can perform the copy picture image control is disclosed in U.S. Pat. No. 4,215,929 (Aug. 5, 1980) entitled IMAGE FORMING METHOD AND APPARATUS CAPABLE OF CONTROLLING AN ELECTROSTATIC IMAGE FORMATION AREA. The disclosed image forming method is performed by an arrangement constituted by a means for superimposing an original picture image exposing light and a control light, a mask member for controlling the control light, and a control means for controlling the mask member. This arrangement is complicated and expensive. Furthermore, since it is intended to obtain a desired region of the original picture image by controlling the control light by the mask member, the control by the control means becomes more complex as a shape of the desired region becomes more complicated.

SUMMARY OF THE INVENTION

An object of the present invention is to provide an electrophotographic apparatus in which a position on a document surface is selected and an exposure to a photosensitive body is controlled in accordance with the selected position on the document surface so that it is possible to perform various copy picture image control operations according to the selected position.

To attain this object, an electrophotographic apparatus according to the present invention comprises: a document irradiation means for irradiating a surface of a document to obtain a reflection image of the surface of the document; an optical system for focusing the reflection image onto a photosensitive body; a photosensitive body irradiation means for directly irradiating the photosensitive body; a position selecting means for selecting a position on the document surface; a position detecting means having a document mounting surface for mounting thereon the document and detecting the position on the document surface selected by the position selecting means; a function selecting means for selecting one of a number of control functions for a picture image; and a control means for controlling at least the operation of the photosensitive body irradiation means in accordance with a signal indicating the position on the document surface detected by the position detecting means, thereby achieving the function selected by the function selecting means. The control means causes the document irradiation means and the focusing optical system to perform a first exposure of the image of the document surface onto the photosensitive body, and the photosensitive body irradiation means to perform a second exposure onto the photosensitive body, and superimposes the first and second exposures.

According to the arrangement as described above, the intensity of exposure to the photosensitive body 1 is adjusted in accordance with the selected position on the document surface so that various processes can be performed with respect to the copy picture image in accordance with the selected position.

Furthermore, the surface of the photosensitive body is divided into a plurality of picture element regions, and each of the divided regions is selectively irradiated by the photosensitive body irradiation means, to thereby make it possible to perform the picture image control with a high resolution. In this case, resolution with respect to the positional detection on the document surface by the position detecting means and resolution with respect to the division of the photosensitive body surface by the photosensitive body irradiation means are caused to coincide with each other, so that there is generated such an effect that an improved picture image forming mode can be realized, in which the selected position on the document and the position to be controlled on the copy picture image can suitably correspond to each other.

DESCRIPTION OF THE PREFERRED EMBODIMENTS

Figure 1:
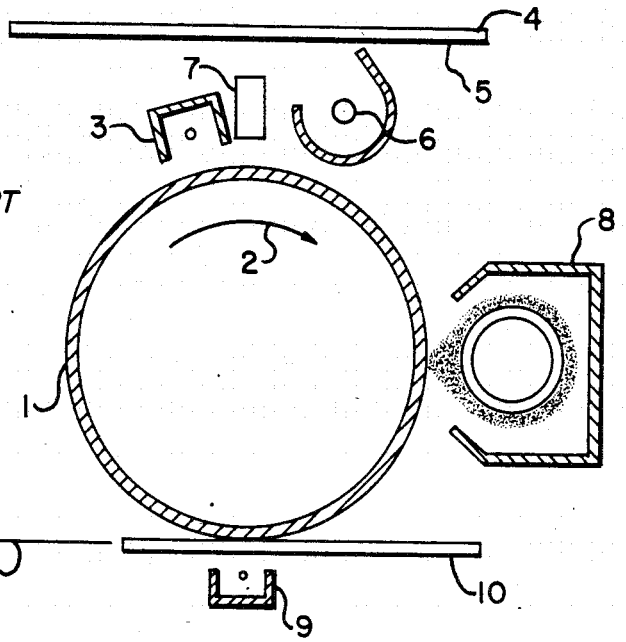
FIG. 1 PRIOR ART
FIG. 1 is a diagram showing a main part schematic arrangement of an example of a conventional electrophotographic apparatus using a Carlson process.

Referring to the drawings, embodiments according to the present invention will be specifically described hereunder.

Figure 2:
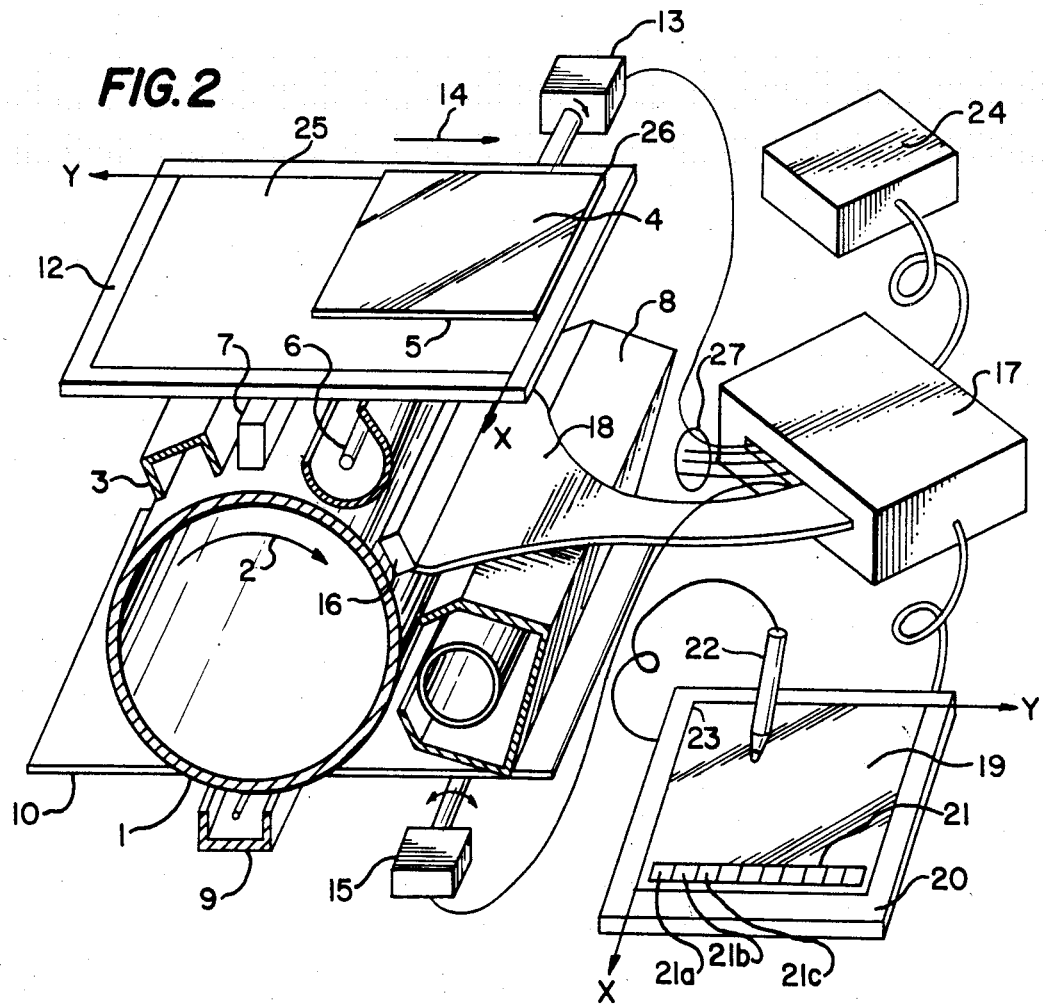
FIG. 2 is a main part perspective view showing an arrangement of an embodiment of the electrophotographic apparatus according to the present invention.

FIG. 2 is a main part perspective view showing an arrangement of an embodiment of the electrophotographic apparatus according to the present invention. In FIG. 2, a photosensitive body 1 rotates in the direction of the arrow 2 in copying, and there are provided a charger 3, a fluorescent lamp 6 functioning as a document irradiation means for irradiating a document surface 5 of a document 4 mounted on a document table 12, and an optical fiber arrangement 7 functioning as a lens to be used as a focusing optical system, all of which are located around the photosensitive body 1. In the drawing, the foregoing document table 12 is moved by a document table drive motor 13 in the direction of the arrow 14 and in synchronism with the rotation of the photosensitive body 1, so that an image of the foregoing document surface 5 is being exposed onto the photosensitive body 1 successively from the right to left end of the document surface 5 mounted on the document table 12.

Electrostatic charges are applied to the photosensitive body 1. An electrostatic latent image is formed by an exposure of the document surface image, and toners are caused to adhere onto the foregoing electrostatic latent image by a developer 8 in accordance with the distribution of the charges thereof so that a visible image is formed on the photosensitive body 1 in the same manner as in the conventional electrophotographic apparatus. Then, the visible image is transferred by a charger 9 onto a copy sheet 10 fed by a copy sheet feed motor 15 in synchronism with the rotation of the photosensitive body 1. In the embodiment according to the present invention, a large number of light emitting diodes 16 are provided between the fluorescent lamp 6 functioning as a document irradiation means and the developer 8 and serve as a photosensitive body irradiation means for directly irradiating the photosensitive body 1 along the axis of the photosensitive body 1. The light emitting diodes 16 are arranged in the form of an array. The quantity of light emitting of the light emission diodes 16 can be set to a predetermined value in accordance with an amount of current flowing in the light emitting diodes 16. A control circuit 17 for controlling the amount of current is connected to the light emitting diodes 16 through a flexible distributing plate 18. The control circuit 17 is connected to a position detecting plate 20 functioning as a position detecting means for mounting the document thereon and for detecting a position on the document 4 indicated on a mounting surface 19. There is provided a function selecting region 21 for selecting various functions of the electrophotographic apparatus on the position detecting plate 20 which is connected to a selecting pen 22 functioning as a position selecting means for slecting the foregoing position on the mounting surface 19. Orthogonal coordinates having X and Y axes with a coordinate origin 23 is formed on the position detecting plate 20.

The document 4 is mounted on the position detecting plate 20 such that one end thereof is made to coincide with the coordinate origin 23, and the document surface 5 is disposed upward, and that ridge lines of the document 4 are disposed along the X and Y axes respectively. The position detecting plate 20 and the selecting pen 22 are electromagnetically connected to each other so as to constitute a coordinate input device of electromagnetic induction type. The control circuit 17 is connected to a storage circuit 24 for storing the positional information applied to the coordinate input device.

Figure 3:
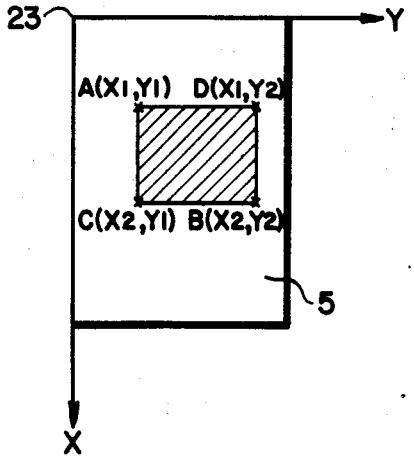
FIG. 3 is a plane view showing an example of positional selection within an X-Y plane on a position detecting plate.

Next, referring to FIG. 3, a description will follow as to an example of positional selection within the X-Y plane on the position detecting plate 20 by means of the selecting pen 22. First, two points A ($X_1$, $Y_1$) and B ($X_2$, $Y_2$) on the position detecting plate 20 are pushed by the selecting pen 22 to thereby apply the two points A and B to the control circuit 17 in which a rectangular region surrounded by points A($X_1$, $Y_1$), C($X_2$, $Y_1$), B($X_2$, $Y_2$) and D($X_1$, $Y_2$), as shown by oblique lines in FIG. 3, is calculated as an a selected position on the basis of the inputs, and then applied to the storage circuit 24 as control information ACBD to be stored therein. There are provided sectioned regions 21*a*, 21*b*, 21*c*, etc., for controlling the desired picture image control in the function selecting region 21 and any one of them is selected by the selecting pen 22 to thereby select a necessary picture image control function. Suitable characters, letters, patterns, or the like, which represent functions are sectionally inscribed by printing on the sectioned regions and it is possible to perform the positional selection and the functional selection by the same selecting pen 22. so that a superior operational capability can be realized.

The first document 4 in which the positional selection on the document surface and the functioned selection are performed in such a manner as described above, is transferred onto the document table 12 with the document surface 5 directed toward a document mounting surface 25.

At that time, on the document mounting surface 25, there are formed orthogonal coordinates having X' and Y' axes with an origin which is a start point 26 in which the respective phases of the document table 12 and the photosensitive body 1 coincide with each other when the document surface image is exposed on the sensitive body 1. In transferring the document 4, one end on the first document 4 and the ridge lines of the document 4 are made to coincide with the coordinate origin 23 and the X and Y axes on the position detecting plate 20 respectively are made to coincide with the starting point 26 and the X' and Y' axes respectively to thereby make it possible to maintain coincidence between the coordinates on the position detecting plate 20 and on the document table 12 as well as coincidence between the starting point 26 on the document table 12 and the phase of the photosensitive body 1. Furthermore, the control circuit 17 has also a control function for controlling the whole electrophotographic apparatus other than the light emitting diodes 16 through wires 27 although the connecting relationship is not shown in the drawing.

Next, a copying operation in the embodiment will be described, by way of example, as to the case where it is necessary to erase the document surface image corresponding to the rectangular region ACBD on the basis of the foregoing procedure. First, a first exposure in which a reflection image of the document surface 5 is successively exposed onto the photosensitive body 1 by the fluoroscent lamp 6 is performed, and an electrostatic latent image corresponding to a document surface image is formed on the photosensitive body 1. Then, a direct second exposure to the photosensitive body 1 is performed by the light emitting diodes 16 and the first and second exposures are superimposed on each other. In the second exposure, the light emitting diodes 16 located within the width $X_1$—$X_2$ corresponding to that of the rectangular region ACBD on the document surface is controlled by the control circuit 17. When the light emission diodes 16 are disposed in a start end $Y_1$ of the length corresponding to that of the rectangular region ACBD, the light emitting diodes 16 are turned on by a sufficient quantity of light emission to erase the electrostatic latent image corresponding to the document surface image. when the light emitting diodes 16 are disposed at the termination end $Y_2$ of the length corresponding to that of the rectangular region ACBD, all of the lighting emitting diodes 16 are turned off.

Next, the photosensitive body 1 in which the electrostatic latent image of the document surface 5 has been formed by the first exposure and then a portion of the electrostatic latent image corresponding to the foregoing rectangular region ACBD have been erased by the second exposure, is developed by the developer 8 to form a visible image.

The control information ACBD is processed with respect to the electrostatic latent image of the document surface 5 of the first document 4 in the example as described above. In the case where it is necessary to erase a document picture image of a portion corresponding to the foregoing rectangular region ACBD, for example, in a document surface of a second document placed in place of the first document 4, the control information ACBD stored in the storage circuit 24 is read out by the controlling circuit 17 and such a copying operation as described above is performed. Thus, the photosensitive body 1 on which an electrostatic latent image of the document surface 29 has been formed by the first exposure, and then the electrostatic latent image of the portion corresponding to the rectangular region ACBD has been erased by the second exposure, is developed by the developer 8 to form a visible image.

Although the portion corresponding to the rectangular region ACBD was erased in the example as described above, alternatively, in the case where the region other than the foregoing position is erased, the on-and off of the light emitting diodes 16 may be inverted.

Furthermore, it is apparent the region selection can be performed by selecting all the vertexes by the selecting pen 22 not only in the case where the selected region is a simple rectangle as shown in FIG. 3 but also even in the case where it is a complex uneven rectangle.

Figure 4:
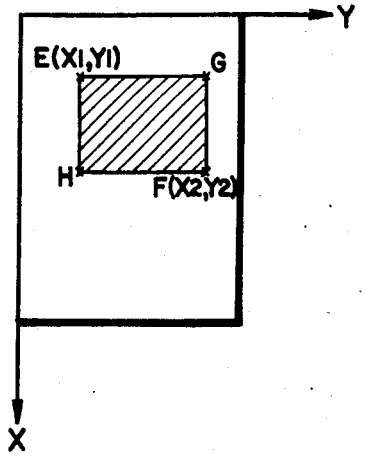
FIGS. 4 to 7 are plane views for explaining a second to a fifth example of positional selection respectively.

FIG. 4 is an explanatory diagram of a second example of the positional selection. As shown in FIG. 4, only two vertexes $E(X_2, Y_1)$ and $F(X_2, Y_2)$ may be indicated if it is found in advance that the indicated region is a simple rectangle (which includes a square). That is, in the control circuit 17, other points $G(X_1, Y_2)$ and $H(S_2, Y_1)$ are generated by performing a calculation on the basis of $X_1$, $Y_1$, $X_2$ and $Y_2$ to thereby make it possible to realize the same function as FIG. 3.

Figure 5A:
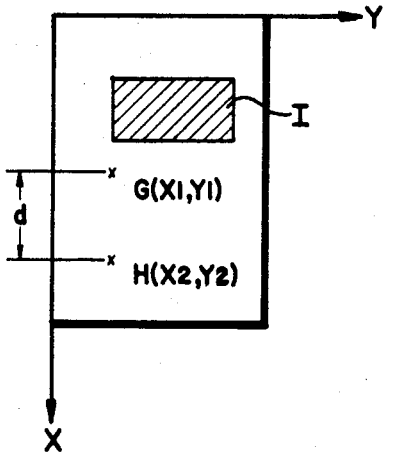
Figure 5B:
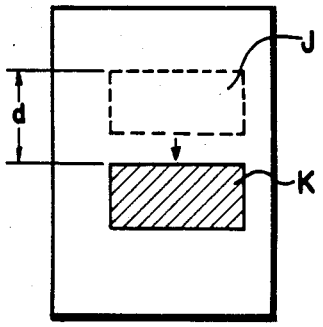

FIG. 5(*a*) is an explanatory diagram of a third example of the positional assignment, in which a rectangular region I is assigned by the method shown in or explained with respect FIG. 3 and a resultant copy is then obtained in which the rectangular region I is displaced in the X-direction by a distance d. After selection of the rectangular region I, points $G(X_1, Y_1)$ and $H(X_2, Y_2)$ are selected such that the distance between the two points G and H is d in the X-direction. The copy sheet feeding motor 15 is controlled by the controlling circuit 17 on the basis of the selection such that the copy sheet 10 is fed with a delay by the distance d relative to the rotation of the photosensitive body 1. Thus, as shown in FIG. 5(*b*), a copy image to be actually formed in a position J is apparently forwardly displaced on the copy sheet by the distance d so as to be formed in a position K.

In the case where the picture image is displaced behind on a copy sheet, the document table drive motor 13 is controlled such that the document table 12 is moved with a lag by a predetermined distance relative to the rotation of the photosensitive body 1.

Figure 6:
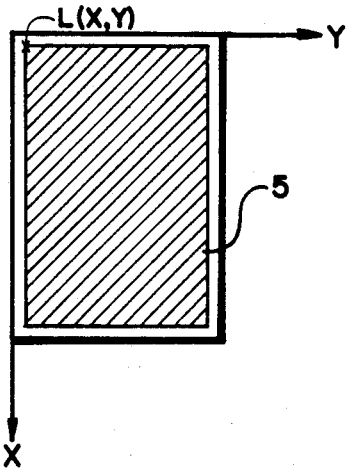

FIG.6 shows a fourth example of the positional selection, in which a picture image of the circumferential portion of the document is erased by a predetermined width. A corner point L(X , Y) is selected on the document surface 5 to thereby generate three remaining points by the control circuit 17 on the basis of a size of the copy sheet and a picture image as shown in FIG. 6 is obtained by the method explained as to FIG. 3.

Figure 7:
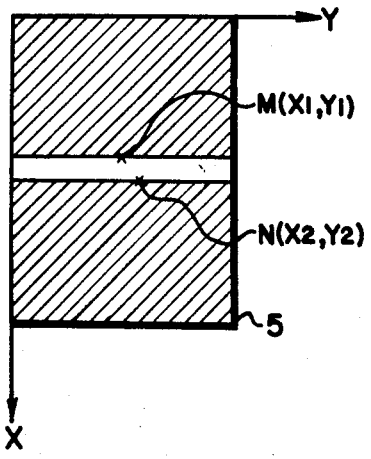

FIG. 7 shows a fifth example of the positional selection, in which in copying a book, such a phenomenon that the center portion of the copied image of the book becomes black is prevented from occurring. A width to be erased in the center portion of the book is selected by two points $M(X_1, Y_1)$ and $N(X_2, Y_2)$ and control is made by the control circuit 17 so as turn on all of the light emitting diodes 16 within the width between $X_1$—$X_2$, thereby obtaining a picture image as shown in FIG. 7.

In the embodiments as described above, in the case where the erroneously selected position on the document surface 5 is to be changed into a correct position upon occurrence of a maloperation by a user, it is necessary to cancel a positional information which has been applied to the control circuit 17. The previously entered positional information in the control circuit 17 is cancelled by selecting correction of the preceding positional selection input by the function selecting means, so that the control circuit 17 becomes in the state where the next positional selection input can be received.

Figure 8:
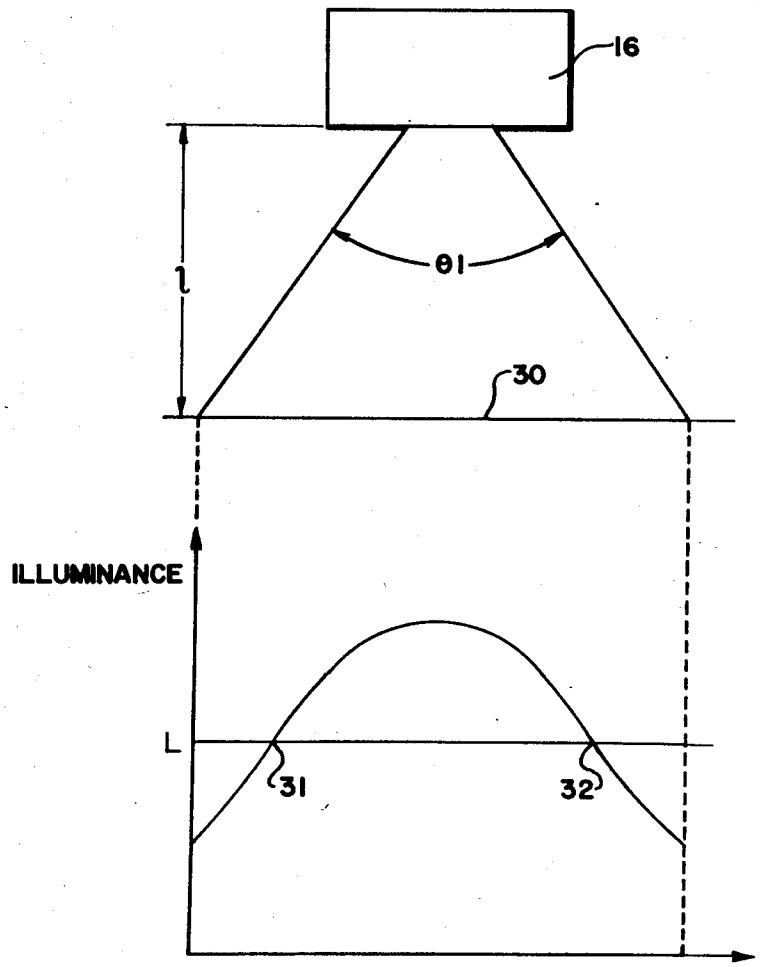
FIG. 8 is a side view and a graph showing light diffusion of a light emission diode array and a distribution of light intensity of the irradiated surface.

Now, the light emitting diodes 16 in such embodiments as described above are a diffusible light source and moreover the light emitting diodes 16 and the photosensitive body 1 are separated from each other by a predetermined distance l. Therefore, there is a possibility that an electrostatic latent image having a region wider than an selected region is erased. Referring to FIG. 8, such a case will be described in detail.

FIG. 8 is a diagram showing a distribution of the light intensity of the irradiation surface 30 on the photosensitive body 1 when the irradiation surface 30 is irradiated by the light emitting diodes 16 with an angle $\theta_1$, and in the graph the ordinate and the abscissa represent the light intensity and the width of the irradiation surface respectively. As shown in the drawing, the light intensity of the irradiation surface 30 is not uniform but lowered with an increase in distance from the emission center of the light emitting diodes 16. Therefore, when the light intensity necessary to erase an electrostatic latent image on the photosensitive body 1 is L (lux), an outline of the erased picture image is not clear because the rate of change in light intensity is gentle at the portions about points 31 and 32 outlining the picture to be erased and therefore there is a possibility that the erased portion becomes wide.

Figure 9:
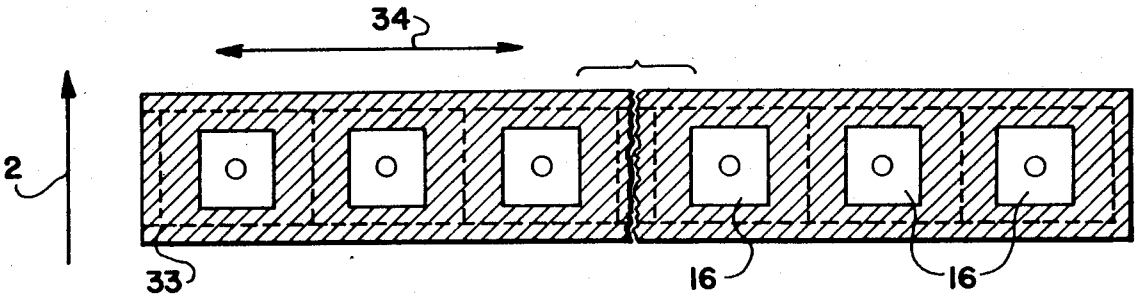
FIG. 9 is a front view showing an arrangement of a light emission diode array and a slit plate in an embodiment according to the present invention.

For this reason, as shown in FIG. 9, a slit plate 33 functioning as a diffusion limiting means is set on the light emission surfaces of the light emitting diodes 16. The slit plate 33 has an opening for every light emitting surface of the light emission diodes 16 so that a part of light is blocked in both the main and subsidiary scanning directions 2 and 34 due to the rotation of the photosensitive body 1. Referring to the drawing, such a case will be described in detail.

Figure 10:
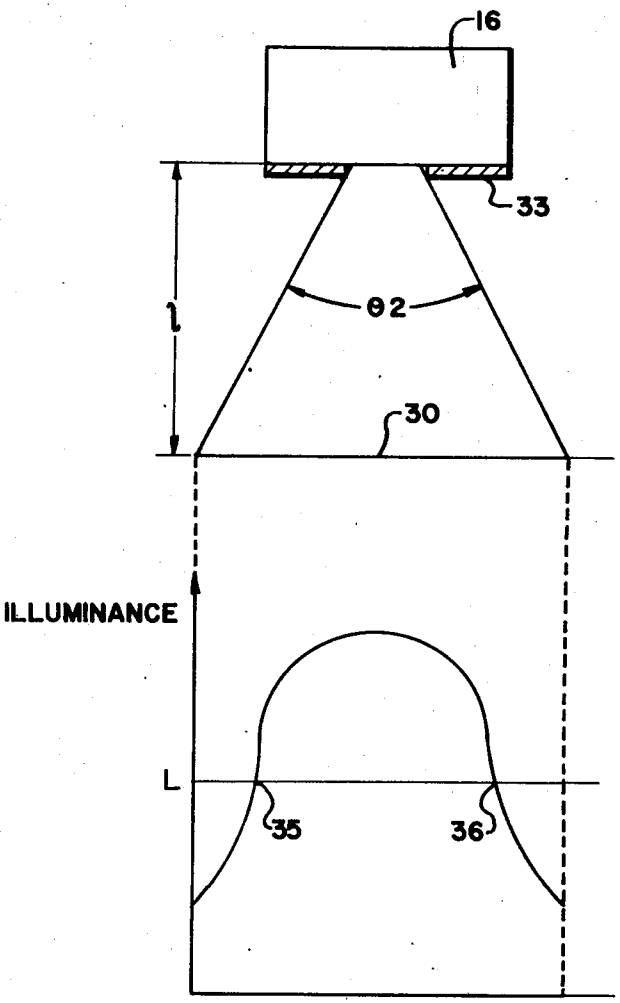
FIG. 10 is a side view and a graph showing the light diffusion of a light emission diode array and the distribution of light intensity of the irradiated surface respectively when a slit plate is attached onto the light emission diode array in an embodiment according to the present invention.

FIG. 10 is a diagram showing the case where the slit plate 33 shown in FIG. 9 is attached onto the surfaces of the light emitting diodes 16 when the irradiation surface 30 is irradiated by the light emission diodes 16 with the same angle $\theta_1$ as in the case of FIG. 8, so that the irradiation surface 30 is irradiated with an angle $\theta_2$ ($\theta_2 < \theta_1$). FIG. 10 further shows a distribution of the light intensity on the irradiation surface 30 in this case and the ordinate and the abscissa represent the light intensity and the width of the irradiation surface respectively. As shown in the drawing, the distribution of the light intensity on the irradiation surface 30 is not uniform even in the case where the slit plate 33 was set on the light emission surfaces of the light emitting diodes 16, but the light intensity is lowered with the increase in distance from the center of the light emission diodes 16. However, setting the slit plate 33 makes the rate of change in light intensity sharp at the points 35 and 36 outlining the picture image to be erased, and therefore the outline of the erased picture image becomes clear as well as the erased portion does not become wide.

Furthermore, the photosensitive body 1 is arranged such that the exposed surface thereof is divided in the subsidiary scanning direction 34 into a plurality of divisions each having an areas exposed by n (n being a positive integer) of the light emitting diodes 16 and that the divisions can be switched with a predetermined time width in the rotational direction 2 of the photosensitive body 1, thereby making it possible to divide the photosensitive surface of the photosensitive body 1 into a plurality of picture element regions each having a clear outline so that a picture image processing can be performed as to every unit picture element.

Although the portion corresponding to the selected region was erased in the the embodiments as described above, the second exposure by the light emitting diodes 16 can be made to function as a bias exposure with respect to the photosensitive body 1, and the whole intensity of exposure to the document portion corresponding to the selected region can be increased by selecting the intensity of light emission of the light emitting diodes 16 to a desired value. Thus, it is possible to decrease only the residual charge at the portion corresponding to the selected region in the electrostatic latent image formed by the first exposure by the fluorescent lamp 6 and the concentration of the visible image formed by the developer 8 can be lowered. Accordingly, in the case where a document in which, for example, only the selected region has a background concentration which is to be copied, the so-called fog in the copy picture image in the selected region can be selectively eliminated.

Furthermore, in the second exposure, the photosensitive body 1 is directly exposed, differing from the case of the first exposure in which the photosensitive body 1 is exposed to the reflection light from the document surface 5 through the optical fiber 7, and therefore the exposure light intensity necessary for a copy picture image processing can be obtained by the relatively smaller intensity of light emission, so that it can be easily realized that the maximum intensity of the second exposure is made larger than a value necessary to erase the residual charge on the photosensitive body 1.

Figure 11:
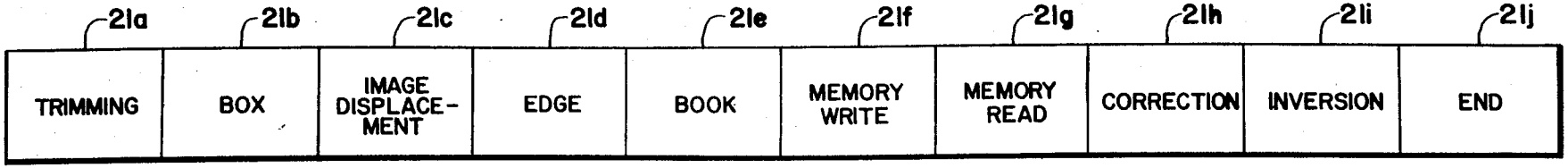
FIG. 11 is a plane view showing an example of sectional inscriptions of sectional regions in a control function selecting region.

FIG. 11 is a diagram showing an embodiment of section inscriptions of the sectioned regions 21*a*, 21*b*, 21*c*. etc., on the function selecting region 21 of the control function in the foregoing embodiments. The respective sectioned regions 21*a*, 21*b*, 21*c*, 21*d*, and 21*e* represent the section inscriptions explained in Figs.3, 4, 5, 6, and 7, and the sectioned regions 21*f* and 21*g* represent the section inscriptions explained in FIG. 2. The sectioned region 21*a* is labelled "trimming" in the sense of photograph trimming and newspaper clipping; the sectioned region 21*b* is labelled "box" in the sense of a simple rectangle; the sectioned region 21*c* is labelled "image displacement" in the sense of displacement of an image picture itself; the sectioned region 21*d* is labelled "edge" in the sense that an object to be erased is a circumferential portion; the sectioned region 21*e* is labelled "book" in the sense that the sectioned region 21*e* is effective in copying a book; the sectioned region 21*f* is labelled "memory write" in the sense that positional information is written into the storage circuit; the sectioned region 21*g* is labelled "memory read" in the sense that positional information is read out of the storage circuit; the sectioned region 21*h* is labelled "correction" in the sense that, for example, previously entered positional information is changed; the sectioned region 21*i* is labelled "inversion" in the sense that a region selected by, for example, "trimming" is caused to remain or be erased, and the sectioned region 21*j* is labelled "end" in the sense of completion of a series of operations.

What is claimed is:

1. An electrophotographic apparatus capable of editing a copy picture image comprising:

a document table for mounting a document thereon;

a document irradiation means for irradiating a surface of said document mounted on said document table to obtain a reflection image on the surface of said document;

an optical system for focusing said reflection image onto a photosensitive body to produce a latent image on said photosensitive body;

a photosensitive body irradiation means for directly and selectively irradiating at least a part of said photosensitive body to erase a part of said latent image on said irradiated part of said photosensitive body;

a development means for developing said latent image on said photosensitive body to form a visible image on a plain sheet;

a position and function selecting means provided separately from said document table and comprising a tablet for first mounting said document thereon prior to said document being mounted on said document table and a pen which is coupled to said tablet so that a position on said tablet is detected by an access of said pen, said tablet being divided into a position selecting area in which positions for defining a desired area ons aid surface of said document mounted on said tablet are selected by said pen and a function selecting area which is divided into a plurality of portions assigned to correspond to a plurality of control functions of said apparatus so that desired one of said control functions is selected by said pen; and a control means for controlling at least said document irradiation means and said photosensitive body irradiation means in accordance with signals indicative of the selected positions and function from said position and function selecting means so as to obtain an edited latent image on said photosensitive body.

2. An apparatus according to claim 1, wherein said controller controls said document irradiation means to irradiate said surface of said document mounted on said document table, and thereafter controls said photosensitive body irradiation means to irradiate said photosensitive body at a part corresponding to said desired area or at a part beside the part corresponding to said desired area.

3. An apparatus according to claim 1, wherein said tablet and pen of said position and function selection means are coupled electromagnetically.

4. An apparatus according to claim 1, wherein said controller has a storage means for storing said signals indicative of the selected positions so as to use said signals repeatedly.

5. An apparatus according to claim 1, wherein said photosensitive body irradiation means comprises an array of plurality of light sources, and a diffusion limiting means adapted to limit diffusion of light from each of said plurality of light sources.

6. An apparatus according to claim 5, wherein said diffusion limiting means comprises an opaque plate member disposed between said array of plurality of light sources and said photosensitive body and being provided with an array of plurality of holes arranged to correspond to said array of plurality of light sources.

7. An apparatus according to claim 1, wherein names of said plurality of control functions are respectively exhibited on said plurality of portions of said function selecting area of said tablet.

8. An electrophotographic apparatus capable of editing a copy picture image comprising:

a document table for mounting a document thereon;

a document irradiation means for irradiating a surface of said document mounted on said document table to obtain a reflection image on the surface of said document;

an optical system for focusing said reflection image onto a photosensitive body to produce a latent image on said photosensitive body;

a developing means for developing said latent image on said photosensitive body to form a visible image on a plain sheet;

a position and function selecting means provided separately from said document table and comprising a tablet for first mounting said document thereon prior to said document being mounted on said document table and a pen which is coupled to said tablet so that a position on said tablet is detected by an access of said pen, said table being divided into a position selecting area in which positions for defining a desired area on said surface of said document mounted on said table are selected by said pen and a function selecting area which is divided into a plurality of portions assigned to correspond to a plurality of control functions of said apparatus so that desired one of said control functions is selected by said pen; and a control means for controlling at least said document irradiation means in accordance with signals indicative of the selected positions and function from said position and function selecting means so as to obtain an edited latent image on said photosensitive body.

9. An apparatus according to claim 8, wherein said tablet and pen of said position and function selection means are coupled electromagnetically.

10. An apparatus according to claim 8, wherein said controller has a storage means for storing said signals indicative of the selected positions so as to use said signals repeatedly.

11. An apparatus according to claim 8, wherein names of said plurality of control functions are respectively exhibited on said plurality of portions of said function selecting area of said tablet.

* * * * *